United States Patent [19]

Reiff

[11] Patent Number: 4,724,558

[45] Date of Patent: Feb. 16, 1988

[54] BEACH BLANKET AND INFLATABLE CHAIR COMBINATION

[76] Inventor: Jeffrey A. Reiff, 9 Cedar St., Valhalla, N.Y. 10595

[21] Appl. No.: 904,040

[22] Filed: Sep. 5, 1986

[51] Int. Cl.[4] ..... A47C 27/08; A47C 1/14

[52] U.S. Cl. ..... 5/455; 5/419; 5/449; 5/417; 297/DIG. 3

[58] Field of Search ..... 5/417, 419, 422, 455, 5/449, 441, 418, 420, 442; 297/DIG. 3, 1

[56] References Cited

U.S. PATENT DOCUMENTS

| | | | |
|---|---|---|---|
| 1,235,669 | 8/1917 | Eggers | 5/455 X |
| 1,329,687 | 2/1920 | Underwood | 5/455 X |
| 2,167,178 | 7/1939 | Kohlstadt | 5/436 X |
| 2,612,645 | 10/1952 | Boland | 5/441 |
| 2,731,652 | 1/1956 | Bishop | 5/455 |
| 3,408,107 | 10/1968 | Savage | 5/457 X |
| 3,499,682 | 3/1970 | Orenstein | 5/455 X |
| 3,572,836 | 3/1971 | Khanh | 5/455 X |
| 3,606,623 | 9/1971 | Aymar | 5/433 |
| 3,712,674 | 1/1973 | Ando | 5/455 X |
| 3,722,012 | 3/1973 | Tobinick | 5/436 |
| 3,740,095 | 6/1973 | Nail | 5/455 X |
| 4,137,584 | 2/1979 | Sharber | 5/417 |
| 4,459,714 | 7/1984 | Lin | 5/441 X |
| 4,489,452 | 12/1984 | Lickert | 5/455 X |
| 4,639,960 | 2/1987 | Quillen | 5/441 X |

FOREIGN PATENT DOCUMENTS

| | | | |
|---|---|---|---|
| 1035000 | 7/1978 | Canada | 5/455 |
| 690523 | 4/1953 | United Kingdom | 5/455 |
| 2052255 | 1/1981 | United Kingdom | 5/441 |

*Primary Examiner*—Alexander Grosz
*Assistant Examiner*—Carl M. DeFranco, Jr.
*Attorney, Agent, or Firm*—Norman B. Rainer

[57] ABSTRACT

A product for recreational beach use is comprised of a beach-blanket type of sheet of generally rectangular shape, and an inflatable chair positioned upon the upper surface of the sheet at a site closer to the rear edge than the front edge. The chair, having a seat and an adjustable backrest portion, can be inflated either by water or by air at a pressure in the range of 5–20 psi. In preferred embodiments, the chair is removably attached to the sheet.

6 Claims, 6 Drawing Figures

BEACH BLANKET AND INFLATABLE CHAIR COMBINATION

BACKGROUND OF THE INVENTION

This invention relates to a product for use on the sand shore of a beach, and more particularly concerns a product which serves both as a beach blanket and chair.

There is widespread interest in recreational or leisure time visits to sandy beaches. For more comfortable relaxation at the beach, a beach "blanket", usually a large sheet or blanket structure, is spread upon the sand so that the beachgoer can sit or lie upon the beach surface without actually being in contact with the sand.

Another item generally brought to the beach is a beach "chair", usually of foldable light-weight construction. The beach chair provides support for the user's back, and is therefore more comfortable than sitting directly upon the sand or the beach blanket, especially if the beachgoer intends to read or converse.

Although the beachgoer will want to bring to the beach equipment, food, and other articles to enhance the enjoyment of the occasion, the carrying and transporting of such items to the beach can be burdensome and diminish the enjoyment of the occasion.

The use of multifunctional beach related items are therefore of interest to the beachgoer, in that they minimize the amount of time and effort required to prepare and pack an automobile or bicycle for the trip to the beach, and in carrying the items onto the beach. Many types of compact beach chairs have earlier been disclosed, and various types of beach blankets are known, including inflatable structures which doubly serve as a raft. Inflatable chairs and related devices which provide support for the user's back are disclosed in U.S. Pat. Nos. 2,612,645; 3,112,956; 3,408,107, and 4,189,181. However, such prior devices are unsuitable for use on a beach or are not properly designed to support the back on a sand surface.

It is accordingly an object of the present invention to provide a product useful as both a beach blanket and beach chair, capable of accommodating one or more persons.

It is a further object of this invention to provide a product as in the foregoing object, a portion of which can be controllably inflated to form a comfortable chair-like structure having back-supporting characteristics.

It is another object of the present invention to provide a product of the aforesaid nature of rugged, durable, light-weight construction and amenable to low cost manufacture.

These objects and other objects and advantages of the invention will be apparent from the following description.

SUMMARY OF THE INVENTION

The above and other beneficial objects and advantages are accomplished in accordance with the present invention by a product comprised of:

(a) a flexible thin sheet, having front and rear edge extremities, and upper and lower surfaces, and (b) an inflatable chair structure attached to said upper surface at a site located closer to the rear edge than the front edge, said chair structure having: (1) an inflatable horizontally disposed seat portion having front, rear and side extremities, (2) an inflatable backrest portion rising upwardly from the rear extremity of said seat portion and directed toward said rear edge, said backrest portion being comprised of one, two or three pillows that lie in contiguous abutment upon the seat portion, (3) paired armrest portions rising upwardly from opposite sides of said seat portion, (4) said component portions of the chair being capable of achieving a turgid, load-supporting state when filled with water, or filled with air at a pressure in the range of 5–20 pounds per square inch, (5) paired support bands extending between the armrest portions and the closest pillow, and (6) fill stems and associated valves associated with each of said inflatable component portions.

In preferred embodiments of the product, the thin sheet is a fabric comprised of woven or knit cotton, canvas, terry cloth, blanket material, or a synthetic plastic film material. Plastic film materials may contain fibrous reinforcement for increased strength and tear resistance, and may in fact be a laminate of two plastic film layers with an intervening fabric layer.

The chair structure may be fixedly attached to the sheet, but is preferably removably attached thereto. The removable attachment may be achieved by way of buttons, zippers, snap fasteners, Velcro fasteners, or a pocket built into the sheet and adapted to accommodate the chair structure.

The chair structure may be comprised of an internal flexible air-tight bladder within an exterior sheath of a protective sturdy fabric. Alternatively, the chair structure may be constructed of a single laminated material which, on the interior has a layer of air-impermeable and water-impervious material, and on the exterior has a layer of protective sturdy fabric. The chair is fabricated in a manner to resist deterioration by salt water, sunlight and temperature variations. The chair must also be puncture resistant and comfortably resilient. The seat and backrest portions preferably represent separate air retaining chambers equipped with separate fill tubes and valves. The chair structure is preferably constructed such that oral inflation can cause the chair structure to become sufficiently rigid to support the beachgoer's weight in the intended manner.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
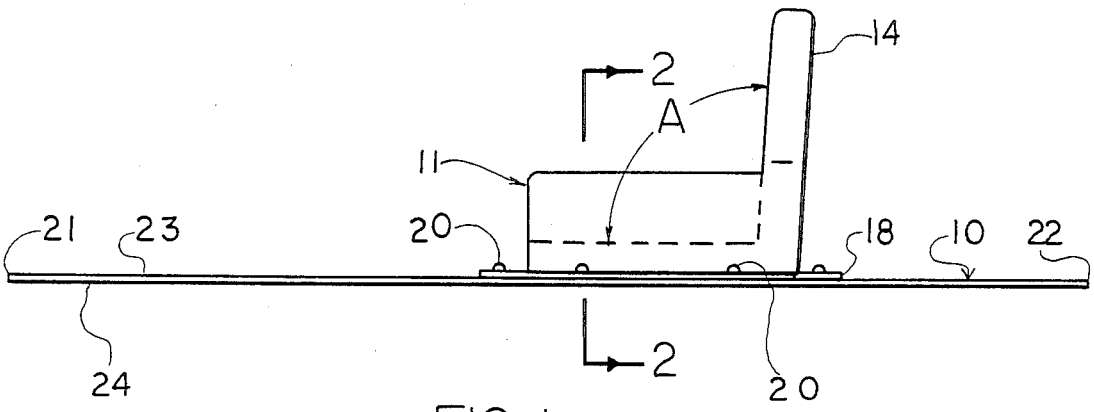
FIG. 1 is a side view of an embodiment of the beach product of the present invention with the chair structure in its erected state.
Figure 2:
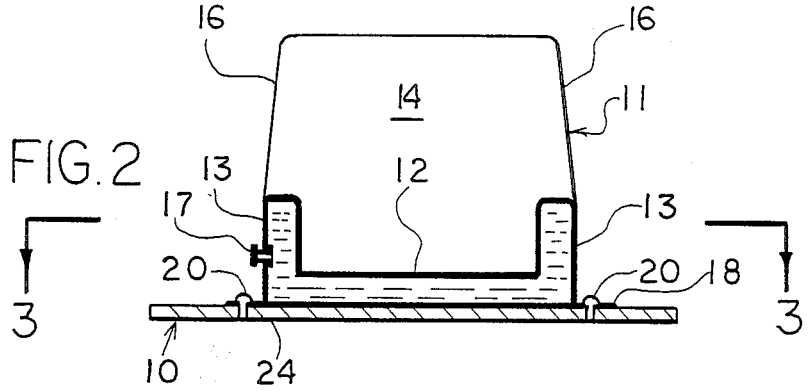
FIG. 2 is a vertical sectional view taken along the line 2—2 of FIG. 1.
Figure 3:
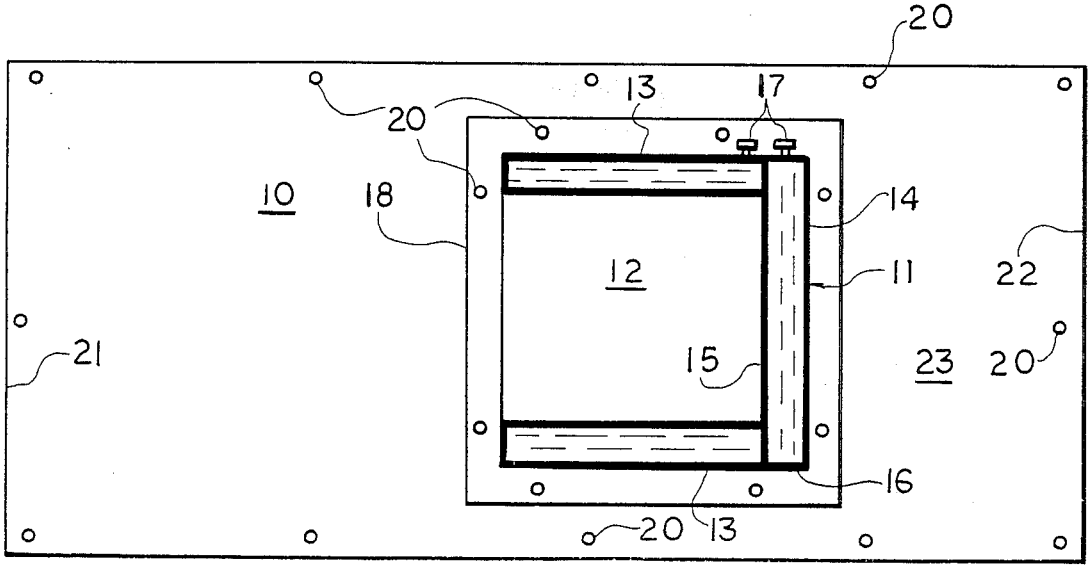
FIG. 3 is a horizontal sectional view taken along the line 3—3 of FIG. 2.

Referring to the FIGS. 1–3, an embodiment of the beach product of this invention is shown comprised of flexible thin sheet 10 of rectangular shape having chair structure 11 positioned thereupon.

The sheet has front and rear edge extremities 21 and 22, respectively, side edges 22, and upper and lower surfaces 23 and 24, respectively. The sheet may measure 5′ by 7′, or larger, and may be provided with snap fasteners or grommets 20 adjacent its edges to provide versatility for other uses. For example, the grommets facilitate use as a tie-down tarpaulin for covering objects protectively with respect to rain and sunlight. The snap fasteners enable two or more of the sheets to be assembled to form a tent or protective covering for other uses. The material of which the sheet is fabricated is preferably chosen so as to impart supple, drapeable characteristics to the sheet while being resistant to deterioration by sunlight. The sheet preferably has a light pastel coloration which minimizes thermal accumulation by virtue of the sun's rays. A reflective metallized surface may in fact by utilized in certain embodiments, in which case the sheet has additional use as a survival blanket for cold weather hikers and campers.

The chair structure is associated with upper surface 23 and is positioned at about two thirds of the distance going from the front to rear edges. Such positioning enables the seated person's legs to rest upon the sheet. The chair structure is comprised of a seat portion 12 which lies in abutment with the sheet, arm rest portions 13 rising upwardly from the seat portion and in communication therewith, and backrest portion 14 rising upwardly from the rear extremity 15 of the seat portion. Lateral edges 16 of the backrest portion are attached to the arm rest portions in a manner which imparts greater structural integrity to the chair structure. The angular disposition of the backrest portion with respect to the seat portion, indicated as obtuse angle A in FIG. 1, is in the range of 100 degrees–160 degrees. The several air-impermeable portions of the chair structure may be joined by methods utilizing plastic bonding agents or cohesive bonding techniques involving heat or solvent; said methods providing air-impermeable seams.

Figure 4:
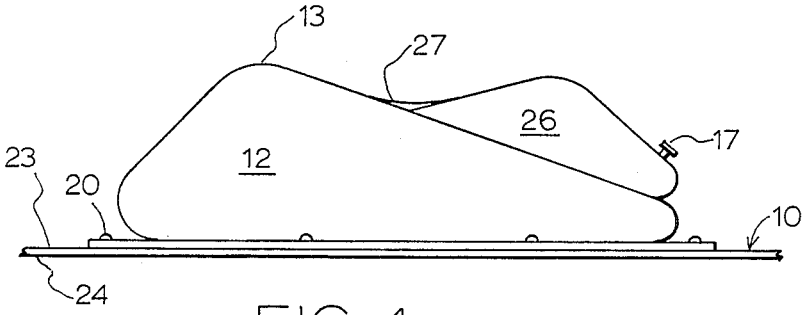
FIG. 4 is a side view of an alternative embodiment of the chair structure.

In the embodiment of FIG. 4, the backrest portion is comprised of a single inflatable pillow 26 having a low profile which provides a reclining angle A in the range of 140 to 160 degrees, depending upon the degree of inflation. A support band 27 extends between the lateral extremities of pillow 26 and arm rest 13.

Figure 5:
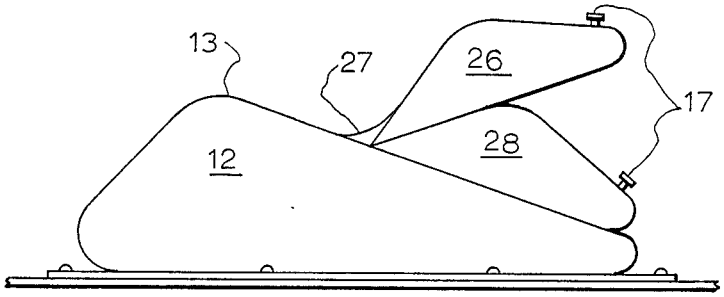
FIG. 5 is a side view of a further embodiment of the chair structure.

In the embodiment of FIG. 5, the backrest portion is comprised of pillow 26 plus second pillow 28. Such configuration provides a reclining angle A in the range of 120 to 140 degrees.

Figure 6:
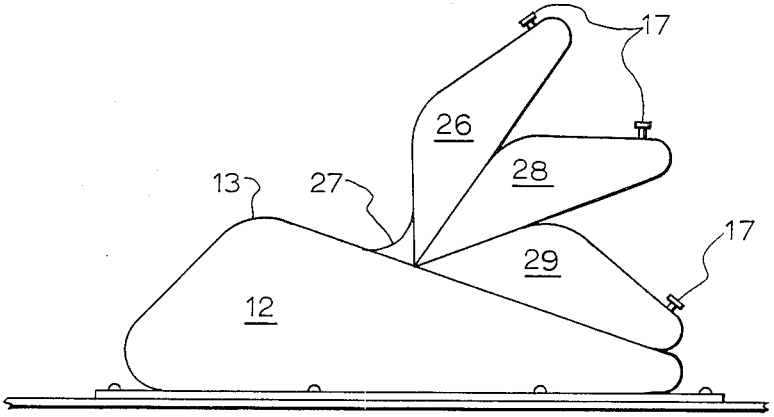
FIG. 6 is a side view of a still further alternative embodiment of the chair structure.

In the embodiment of FIG. 6, the backrest portion is comprised of pillows 26 and 28 plus a third pillow. When the three pillows are inflated to a desired degree, the backrest configuration of FIG. 6 provides a reclining angle A in the range of 100 to 120 degrees.

Fill stems and valve combinations 17 are associated with all inflatable portions of the chair structure. The construction of the fill stem/valve is such as is conventionally utilized on water sports bouyancy jackets which permit the jackets to be orally inflated or filled with water. Additionally, a valve of the type utilized on bicycle tires may be incorporated into valves 17, thereby facilitating inflation by means of a small hand-operated bicycle pump capable of achieving pressures as high as 30 psi.

The lower portion of the chair structure is shown comprised of a surrounding skirt 18 having a number of snap fasteners 20 interactive with the underlying sheet. By virtue of such arrangement, the chair structure can be removed for filling with the water of the body of water adjacent the beach, or can be removed for the purpose of washing or permitting other uses of the sheet or chair structure. When the chair structure is deflated, the combined chair structure and sheet can be folded or rolled to a lightweight compact state well suited for easy carrying or storage.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An inflatable beach chair and blanket combination comprising:

(a) a flexible thin sheet, having front and rear edge extremities, and upper and lower surfaces, and (b) an inflatable chair structure removably attached to said upper surface at a site located closer to the rear edge than the front edge, said chair structure being fabricated of resilient plastic sheet material having: (1) an inflatable horizontally disposed seat portion having front, rear and side extremities, (2) an inflatable backrest portion rising upwardly from the rear extremity of said seat portion at an angle of between about 100 and 160 degrees and directed toward said rear edge, said backrest portion being comprised of from one to three separately inflatable pillow compartments that lie in contiguous abutment upon the seat portion, (3) paired armrest portions rising upwardly from opposite sides of said seat portion, and bonded to said seat and backrest portions, (4) said seat, backrest, and armrest portions of the chair structure being capable of achieving a turgid, load-supporting state when filled with water, or filled with air at a pressure in the range of 5–20 pounds per square inch, (5) paired support bands extending between the armrest portions and the pillow compartments of said backrest portion, and (6) fill stems and associated valves associated with each of said inflatable portions of the chair structure, and (c) fastening means for removably attaching said inflatable chair structure to said upper surface of said flexible thin sheet.

2. The combination of claim 1 wherein said sheet is a supple fabric.

3. The combination of claim 1 wherein said sheet is comprised of a plastic film.

4. The combination of claim 1 wherein said chair structure is positioned at about two thirds of the distance going from the front to rear edges of the sheet.

5. The combination of claim 1 wherein said sheet has snap fasteners or grommets adjacent its edges.

6. The product of claim 1 wherein said plastic is plasticized polyvinylchloride.

* * * * *